US010477995B2

(12) United States Patent
Lervik et al.

(10) Patent No.: US 10,477,995 B2
(45) Date of Patent: Nov. 19, 2019

(54) MOUNTING DEVICE

(71) Applicant: Absolut Art AB, Stockholm (SE)

(72) Inventors: Alexander Lervik, Stockholm (SE); Jesper Blom, Täby (SE); Hampus Krantz, Täby (SE)

(73) Assignee: Absolut Art AB, Stockholm (SE)

( * ) Notice: Subject to any disclaimer, the term of this patent is extended or adjusted under 35 U.S.C. 154(b) by 0 days.

(21) Appl. No.: 15/774,688

(22) PCT Filed: Nov. 8, 2016

(86) PCT No.: PCT/SE2016/051098
§ 371 (c)(1),
(2) Date: May 9, 2018

(87) PCT Pub. No.: WO2017/082802
PCT Pub. Date: May 18, 2017

(65) Prior Publication Data

US 2018/0325288 A1 Nov. 15, 2018

(30) Foreign Application Priority Data

Nov. 9, 2015 (SE) ..... 1551443

(51) Int. Cl.
*A47G 1/24* (2006.01)
*A47G 1/16* (2006.01)
*A47B 97/00* (2006.01)

(52) U.S. Cl.
CPC ..... *A47G 1/164* (2013.01); *A47B 97/001* (2013.01)

(58) Field of Classification Search
CPC .... A47G 1/164; A47G 1/1626; A47G 1/1633; A47B 97/001
See application file for complete search history.

(56) References Cited

U.S. PATENT DOCUMENTS 2,943,831 A 7/1960 Goss
6,003,825 A 12/1999 Abernathy, Jr.
(Continued)

OTHER PUBLICATIONS

International Search Report and Written Opinion for corresponding Patent Application No. PCT/SE2016/051098 dated Feb. 8, 2017.
(Continued)

*Primary Examiner* — Bradley Duckworth
(74) *Attorney, Agent, or Firm* — Renner, Otto, Boisselle & Sklar, LLP

(57) ABSTRACT

A mounting device (1) for adjustable mounting of an object on a wall comprises a housing (3), comprising a body (5) and a lid (7). The body (5) is adapted for being mounted on the wall. The device (1) further comprises a substantially vertically extending adjustment element (9) extending through the housing (3), and a receiving element (11) connected to an end of the adjustment element (9). The receiving element (11) is adapted for receiving the object to be mounted on the wall. The device (1) further comprises a locking element (13) arranged within said housing (3) for locking movement of the adjustment element (9), the locking element (13) being arranged to be selectively movable between a movement restriction state and a movement allowing state. Further, a release mechanism (15) is arranged in the housing (3) for selectively moving the locking element (13) from the movement restriction state to the movement allowing state, wherein the movement of the release mechanism (15) is controlled by moving the receiving element (11) away from the wall.

9 Claims, 9 Drawing Sheets

(56) References Cited

U.S. PATENT DOCUMENTS

| | | | | |
|---|---|---|---|---|
| 6,095,479 | A * | 8/2000 | Brindisi | A47G 1/1613 248/476 |
| 6,663,075 | B2 * | 12/2003 | Zuller | A47G 1/164 248/476 |
| 8,899,541 | B2 * | 12/2014 | Bixler | A47G 1/164 248/295.11 |
| 9,370,267 | B2 * | 6/2016 | Greve | A47G 1/24 |
| 9,765,923 | B2 * | 9/2017 | Skull | G06F 1/16 |
| 9,907,401 | B2 * | 3/2018 | Selwa | A47B 97/001 |
| 2003/0029986 | A1 | 2/2003 | Zuller | |
| 2013/0233992 | A1 | 9/2013 | Darré et al. | |
| 2016/0278549 | A1 * | 9/2016 | Deri | A47G 1/202 |
| 2018/0289179 | A1 * | 10/2018 | Fastermann | A47G 1/164 |
| 2019/0032843 | A1 * | 1/2019 | Burton | F16M 13/02 |

OTHER PUBLICATIONS

International Preliminary Report on Patentability for corresponding Patent Application No. PCT/SE2016/051098 dated Oct. 24, 2017.

* cited by examiner

MOUNTING DEVICE

This application is a national phase of International Application No. PCT/SE2016/051098 filed Nov. 8, 2016 and published in the English language, which claims priority Swedish Patent Application No. 1551443-3 filed Nov. 9, 2015, which are hereby incorporated herein by reference.

TECHNICAL FIELD

The present invention relates to a mounting device, for adjustable mounting of objects on a wall, in particular mounting of paintings on a wall.

BACKGROUND ART

When mounting objects on a wall, in particular objects such as paintings or a TV or similar, positioning and placement is very important and it is also often very difficult to achieve perfect results. For mounting a painting on a wall in a building the subjective quality of the positioning and placement often relies on other objects surrounding the painting. These other objects may be things such as other paintings and/or shelves in the vicinity of the painting being mounted. It is also common to place a series of paintings in a uniform arrangement where a small displacement of one painting often causes the complete image to be unsatisfying to the eye of an observer.

The most common and well known method for mounting a painting on a wall is to simply insert a screw or a nail in said wall and attach a string or a wire on the backside of the frame of the painting and hang said string or wire over said screw or nail. This is a very simple method but is has the drawback the results may vary quite a lot when several paintings are mounted in an arrangement. If the results are unsatisfying the painting needs to be taken down to allow for adjustments, such as moving the screw or nail, adjust the length of the string or wire, or change the location of the attachments for the string or wire made in the frame of the painting.

U.S. Pat. No. 6,003,825 show an advancement in the technical field and discloses a mounting device comprising a horizontal bar, a vertical bar and a connector arranged for a sliding arrangement of said bars. The device is used by fixedly mounting the horizontal bar on the wall and then slide the connector horizontally on said bar, and slide the vertical bar vertically within the connector. When a desired position is achieved a spring-loaded pin in the connector is used to fix the two bars in respect to the connector in pre-arranged holes in said bars. The vertical bar provides hooks in which a wire attached to a painting can be placed. This device offers better adjustment means for a painting as the device itself can be adjusted without removing it from the wall.

The device of U.S. Pat. No. 6,003,825 does however have some drawbacks. Firstly, the adjustments made can only be performed in definite steps as it is dependent on the pre-arranged holes in the two bars. If several paintings are to be mounted in a uniform line on a wall is not guaranteed that the pre-arranged holes align perfectly which can lead to non-perfect placement of the plurality of paintings in relation to each other. Further, the device demands the removal of the painting before adjustments can be made as the spring-loaded pin is situated in the middle of the device behind the painting. This can lead to a taxing process of removing and re-hanging the painting between adjustments, as the end result is not seen until the painting is re-attached to the device.

There is thus a need for an improved device for adjustable mounting of objects on a wall which removes the above mentioned disadvantages with prior art.

SUMMARY

The object of the present invention is to provide a mounting device for adjustable mounting of objects on a wall which device overcomes the drawbacks of prior art. More specifically the object of the invention is to provide a mounting device which allows for adjustment of the placement of the object being mounted without the need to remove the object from the device when performing said adjustments. This object is achieved by the features of the characterising portion of claim 1. Further advantages of the invention are described with reference to the dependent claims.

According to a first aspect of the invention, the invention discloses a mounting device for adjustable mounting of objects on a wall. The device comprises; a housing comprising a body and a lid, wherein the body is adapted for being mounted on the wall, a substantially vertically extending adjustment element extending through the housing, and a receiving element connected to a first end of the adjustment element, which receiving element is adapted for receiving the object being mounted on the wall. The device is characterized in that it further comprises a locking element arranged within said housing, the locking element being arranged to be selectively movable between a movement restriction state and a movement allowing state. Further, a release mechanism is arranged in the housing for selectively moving the locking element from the movement restriction state and the movement allowing state. A relative movement of the locking element in relation to the release mechanism can be controlled by moving the object in relation to the wall when said object is connected to the receiving element.

This has the advantage that a device is provided, which device can be used to mount an object on a wall by means of said device while the adjustment of the positioning/placement of the object can be controlled by moving the object without the need to remove it from the mounting device. This is beneficial as a process of adjusting an object on a wall, in particular a painting, becomes less time consuming and more precise as the end result in regards to the placement of the object in relation to its position on the wall can be seen directly during the said adjustment process.

According to another aspect of the invention the adjustment of the object is a stepless adjustment.

This has the advantage that the placement of the object is very precise with a high accuracy. This further has the advantage that two mounting devices used side by side to mount two separate objects are guaranteed to be able to achieve a uniform placement of said two objects in relation to each other as the device is not restricted by a finite number of settings dictated by the design of the device.

According to yet another aspect of the invention the movement restriction state of the locking element restricts movement of the receiving element in a direction along the extension of the adjustment element, towards the housing, but allows moment of the receiving element away from the housing, and the movement allowing state of the locking element allows free movement of the receiving element both towards and away from the housing, along the extension of the adjustment element.

This has the advantage that the positioning of the object in relation to the wall can be performed in relation to the housing, along the length of the adjustment element, which in particular relates to the height of the object on the wall. This alleviates the precision needed when mounting the housing to the wall as there is no need to place the housing at the exact correct height. If the desired positioning is located within the reach of the extension of the adjustment element, in a direction of the receiving element, in relation to the housing, a final correct height placement of the object is always possible.

According to a further aspect of the invention moving the object being mounted, while connected to the receiving element, away from the wall, moves the locking element to the movement allowing state.

This has the advantage that a very simple action, performed by means of moving the object in relation to the wall, can be utilized to adjust the positioning of the object. A further advantage is that the positioning of the object can be performed in several directions by a slight change in movement done by hand. This creates a very fluid like movement for a person adjusting the height of the object in combination with moving the locking element between the movement restriction state and the movement allowing state.

According to an even further aspect of the invention the receiving element is a substantially horizontal extending bar, allowing connection between the receiving element and the object throughout the extension of said bar.

This has the advantage that that the positioning of an object can be adjusted both vertically and horizontally as the object can be supported over the entirety of the substantially horizontal bar. This is advantages as an object can be positioned with high accuracy in two dimensions in an easy manoeuvrable way without the need to remove the object from the mounting device in between adjustments.

According to another aspect of the invention the device further comprises a connecting element arranged for detachable fixed connection to the object and comprising connecting means arranged for a detachable fixed connection to the receiving element.

This has the advantage that a precise device for adjustable mounting of an object on a wall with a high accuracy is provided. As the intermediate connecting element is designed to fit the receiving element with high accuracy and can be designed in various ways do fit different types of object, such as different models of frames for paintings, it is easy to customize the mounting device in a wide variety of ways without re-modelling the entire device.

According to yet another aspect of the invention the locking element is an extending bar in which a hole is arranged, wherein the adjustment element pass through said hole and wherein the extending bar is supported in the housing on one side of said bar.

This has the advantage that the locking element can utilize gravity as a locking inducing mechanism as the bar will fall downwards on the side where it lacks support. This will in turn narrow the hole in a vertical direction which will cause a locking effect and restrict movement in a downward direction. This is beneficial as the locking element can be manufactured in a very simple and cheap way but still provide an excellent functionality for the device.

According to a further aspect of the invention the release mechanism comprises an angled surface which, when it engages the locking element, moves the locking element from the movement restriction state to the movement allowing state.

This has the advantage that a simple geometrical shape can be utilized to control the state of the locking mechanism. As the release mechanism is based on a simple geometrical shape there is less risk of failure for the mechanism as there are less parts present which could cause a potential failure in the device. By designing the release mechanism in a simple way manufacturing costs are also lowered which is another advantage from an economical viewpoint.

According to an even further aspect of the invention the locking element is biased by a section of the body to not engage the release mechanism until it is subjected to a force of a pre-determined value.

This has the advantage that the locking element will firmly be kept in the movement restriction state and hence keep the adjustment element in a fixed position until enough force is applied by a person, which force exceeds the pre-determined value and causes a relative movement of the locking element in relation to the release mechanism. The relative movement then shifts the locking element to the movement allowing state to allow for adjustment of the object.

According to another aspect of the invention the housing further comprises a spirit level.

This has the advantage that a perfectly horizontal positioning of the housing easily can be achieved, which in turn provides a perfectly vertical alignment of the adjustment element. This is beneficial as a person performing an adjustment in the vertical direction can be sure that said adjustment is executed solely in said vertical direction.

BRIEF DESCRIPTION OF THE DRAWINGS

The present invention will now be described in detail with reference to the figures, wherein.

DETAILED DESCRIPTION

Hereinafter different embodiments of the invention will be described associated with the enclosed drawings. Reference numbers are not to be viewed as restrictive in relation to the scope of the protection given by the patent claims, only as assistance in understanding the drawings and the various technical features of the invention.

As will be realized the invention can be modified in various ways without deviating from the scope of the claims, and aspects of the different embodiments may be combined to achieve a variety of combined technical features and embodiments. Hence, the drawings and the description should be viewed as illustrative and not restrictive.

Figure 1:
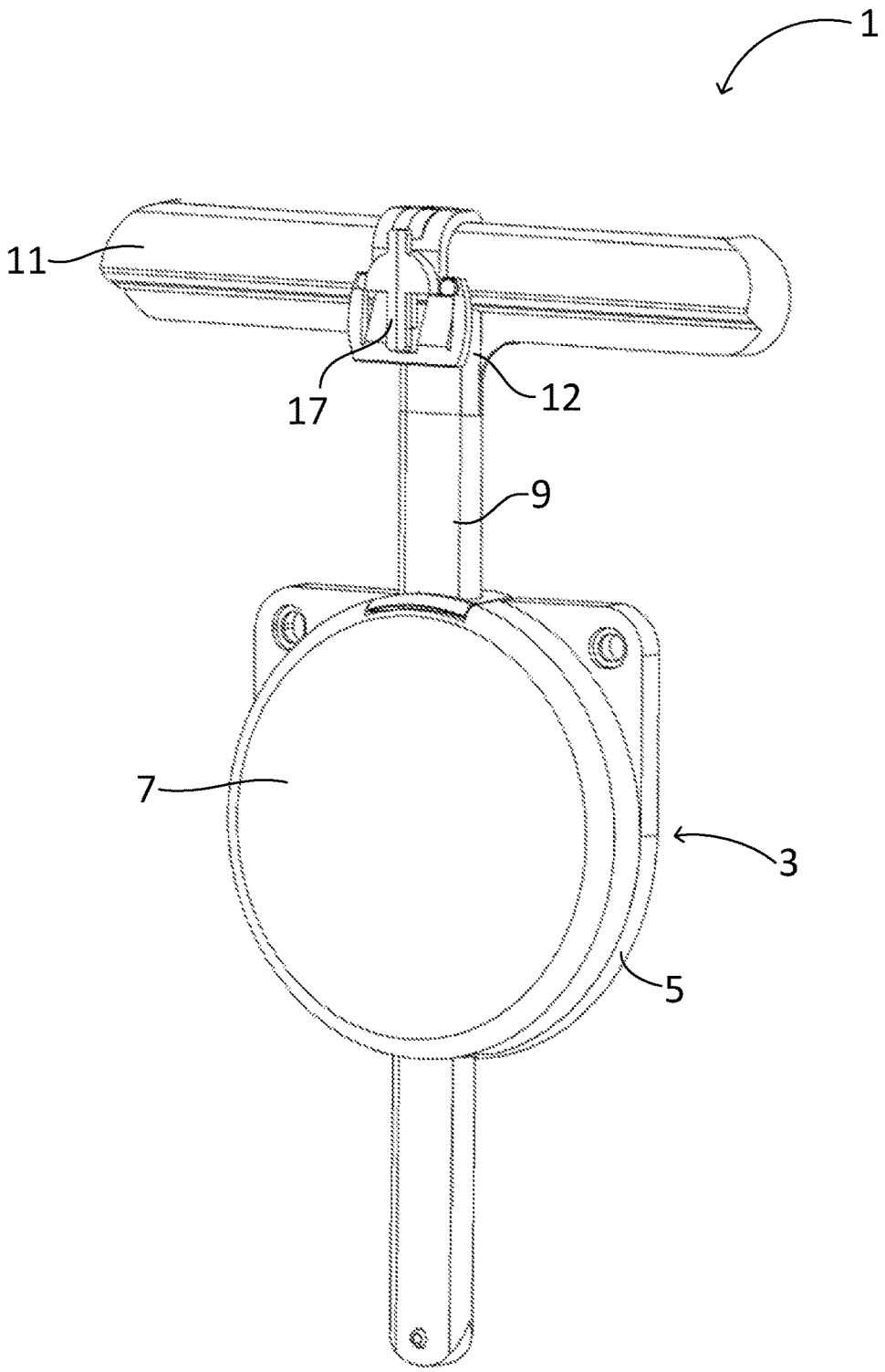
FIG. 1 shows a perspective of an example of a mounting device.

FIG. 1 shows a perspective of an example of a mounting device 1 according to the present invention, more specifically a mounting device 1 for adjustable mounting of an object on a wall. The mounting device 1 comprises a housing 3 comprising a body 5 and a lid 7, the body 5 being adapted for being mounted on the wall. The device 1 further comprises a substantially vertically extending adjustment element 9 extending through the housing 3, and a receiving element 11 connected to a first end 12 of the adjustment element 9. The receiving element 11 is adapted for receiving the object being mounted on the wall. The mounting device 1 further comprises a locking element 13 (seen in FIG. 2*a*) arranged within said housing 3, the locking element 13 being arranged to be selectively movable between a movement restriction state and a movement allowing state, and a release mechanism 15 (seen in FIG. 2*a*) arranged in the housing 3 for selectively moving the locking element 13 from the movement restriction state and the movement allowing state. Shifting the locking element 13 between the movement restriction state and the movement allowing state is done by means of a relative movement of the locking element 13 in relation to the release mechanism 15. Said relative movement can be controlled by moving the object in relation to the wall when said object is connected to the receiving element 11. The mounting device 1 of this example further comprises a connecting element 17 removable attached to the receiving element 11 of the device 1. The receiving element 11 of this example is adapted in shape and design to fit said connecting element 17. The fit between the receiving element 11 and the connecting element 17 is designed to snap together so that removal of the connecting element 17 from the receiving element 11 only is possible when desired, by an action performed selectively by a user. This is however only an example and other designs are possible, wherein the receiving element 11 is shaped and designed to receive other means of attachment in regards to an object being mounted on a wall by means of the device 1.

The receiving element 11 of the example depicted in FIG. 1 is a substantially horizontally extending bar, which allows for connection with the connecting element 17 throughout the extension of said bar. This applies for means of a connecting element other than the one described in this example as well. If for example a regular screw or nail is used as a connecting element for connection with the object being mounted, the receiving element 11 is then designed to receive said screw or nail all along the extension of the horizontal bar. The horizontal extension of the receiving element 11 hence provides adjustment of the object being mounted in a horizontal direction, dictated by the extension of the bar.

The substantially vertically extending adjustment element 9 of this example extends through the housing 3, providing vertical adjustment of the object being connected to the receiving element 11. The locking element 13 and the release mechanism 15 arranged within the housing 3 provide means of controlling said adjustment. By controlling the state of the locking element 13 by means of movement of the receiving element 11 and the adjustment element 9 in relation to the wall the adjustment of the object can be performed. By default the locking element 13 of this example is in a movement restriction state which restricts movement of the adjustment element 9 as will be described in more detail below. Further, in this example, if the first end 12 of the adjustment element 9 is tilted outwards, in relation to the wall behind the housing 3, the locking element 13 moves to the movement allowing state. The adjustment element 9 is further supported in the housing 3 by a section 19 (seen in FIG. 2*a*) of the body 5 of the housing 3, which section 19 can be moved in relation to the rest of the body 5. The housing 3 is preferably made of a somewhat flexible metal or plastic material. This means that the section 19 of the housing 3 can be temporary flexibly displaced in relation to the rest of the body 5 and hence temporary displace the adjustment element 9 in the above described tilted way. This flexibility of the material of the body 5 will then flex back when released, causing the adjustment element 9 to move back to an upright position. This creates a spring loaded-like mechanism for the adjustment element 9. Other ways of achieving this type of mechanism is of course possible, such as using more rigid materials for the housing 3 and incorporate elements such as hinges and springs to bias the section 19 of the body 5 to behave in the same manner as described above.

The movement restriction state of the locking element 13 restricts movement of the receiving element 11 in a direction along the extension of the adjustment element 9, towards the housing 3, but allows moment of the receiving element 11 away from the housing 3. For the example depicted in FIG. 1, this means that the receiving element 11 can be moved up along the direction of the extension of the adjustment element 9 by means of sliding the adjustment element 9 through the housing 3. The total possible displacement of the receiving element 11 and hence also the object being connected to the receiving element 11 is dictated by the length of the adjustment element 9. The movement allowing state of the locking element 13 allows free movement of the receiving element both towards and away from the housing 3, along the direction of the extension of the adjustment element 9, by means of sliding said adjustment element 9 through said housing 3. For the example depicted in FIG. 1, this means that the object can be moved freely up and down when the locking element 13 in the movement allowing state.

This provides a mounting device 1 which can be used to easily adjust the position/placement of an object connected to the device 1, both horizontally and vertically. Further, the device 1 can easily be shifted between two states, which control the adjustment possibilities of the object. The horizontal and vertical adjustments of the object in relation to the wall can both be performed without removing the object from the mounting device 1. For the example of the object being a painting, a very precise and easy to use device 1 for placing and adjusting the placement of said painting is provided.

Figure 2A:
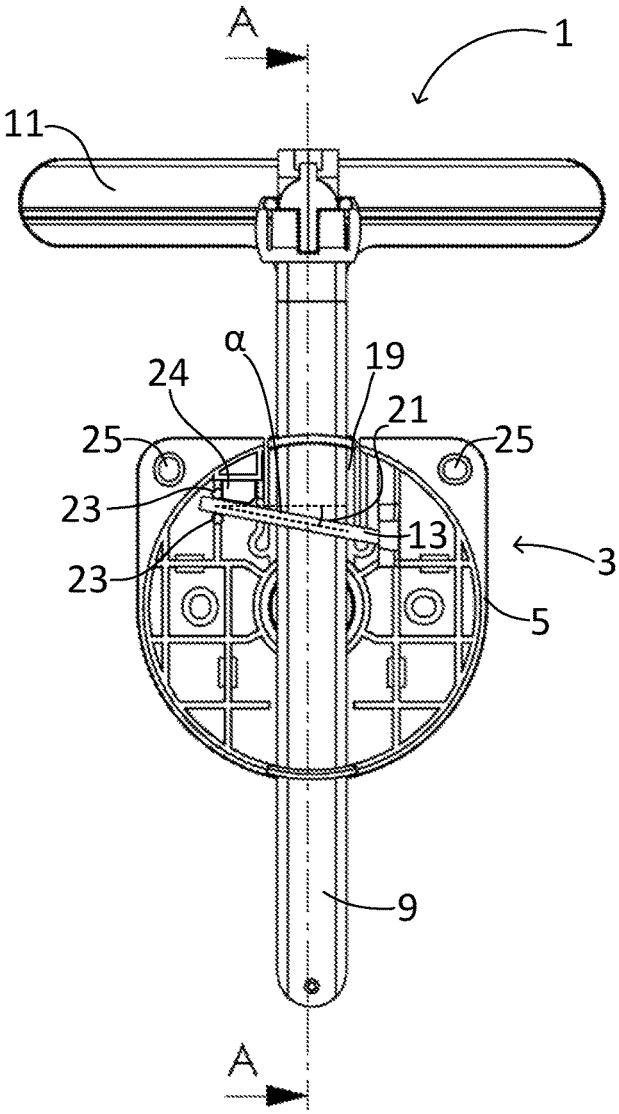
FIG. 2*a* shows a front view of an example of a mounting device with an uncovered housing.

FIG. 2*a* shows a front view of an example of a mounting device with an uncovered housing. In this example the locking element 13 is seen in detail. The locking element 13 of this example is an extending bar in which a hole 21 is arranged, wherein the adjustment element 9 pass through said hole 21 and wherein the extending bar is supported in the housing on one side of said bar. The locking element 13 is loosely supported by means of two substantially round support projections 23, extending perpendicular outwards from the body 5 of the housing 3. This allows for a pivotal movement of the locking element 13 about an axis situated between the two support projections 23, extending parallel to said projections 23. The hole 21 of the locking element 13 is close in size to, but slightly larger than, the cross sectional area of the adjustment element 9. As the locking element 13 is only loosely supported, and supported on one side only, the locking element 13 is prone to tilt downwards at an angle α. This creates an arrangement where the width of the hole 21, in a horizontal direction, will be lowered when the locking element 13 is tilted. This in turn means that the edges of the hole will engage the sides of the adjustment element 9, which will lock the adjustment element 9 in place in regards of downwards movement. If the adjustment element 9 is moved upwards, the unsupported side of the locking element 13 can follow the upwards movement which will release the locking engagement. As is obvious, this describes the movement restriction state of the locking element 13, which allows an upward directed adjustment of the adjustment element 9. As soon as an upward directed adjustment is completed and the person performing the adjustment let go of the object and the device 1, gravity will cause the locking element 13 to again engage and grip the adjustment element 9 in a fix position. The housing 3 may further comprise a resilient element 24, arranged in abutment to the locking element 13. Said resilient element 24 is arranged to provide a downward directed force to the locking element 13 so as to push the locking element 13 down towards the movement restriction state. The resilient element 24 may thus assist in said downwards movement which may be beneficial, both as the risk of the locking element 13 getting stuck in the movement allowing state is reduced, and that the resilient element 24 also may provide a smoother movement of the adjustment element 9 within the locking element 13. The resilient element 24 is preferably made of a polymeric material which is naturally resilient due to the material properties of said material. Other resilient elements 24 are however also possible, such as an element in the form of a spring or similar.

The example of FIG. 2*a* further shows two holes 25 in the housing 3 of the mounting device 1. These holes 25 are arranged for the mounting of the device 1 on the wall. The number of holes 25 may be altered depending on the size of the device 1 and the weight of the objects supposed to be mounted by means of the device 1. In this example the two holes 25 are placed outside of the body 5 of the housing 3, not covered by the lid 7 when the lid 7 is attached to the body 5. However, the holes 25 may also be placed within the covered body 5, covered by the lid 7. The holes 25 of this example are slightly oval in shape to allow for some degrees of freedom when positioning the device 1 so that the adjustment element 9 is perfectly vertically aligned. Other means of achieving this are also possible however, such as providing a built-in spirit level in the housing 3.

The tilted locking element 13 providing the locking mechanism for the adjustment element 9 further means that the adjustments performed are fully stepless. As no definite and fixed intervals are arranged on the adjustment element 9, all adjustments are sliding adjustments which provide a fluent and precise positioning of objects by means of the adjustment element 9. This further means that the housing 3 not necessarily needs to be perfectly positioned on the wall, as the adjustments in both vertical and horizontal directions are sliding adjustments. This further means that the object being placed can be placed at exactly every position within the range of adjustments defined by the sliding arrangements, which can counter a slightly misaligned angle of the receiving element 11.

For a more in-depth description of the movement restriction state and the movement allowing state and how to shift the locking element 13 between said two states, see the description with reference to FIG. 7*a*-7*c* and FIG. 8*a*-8*c*.

Figure 2B:
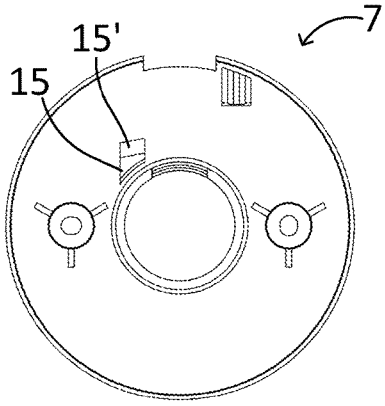
FIG. 2*b* shows a front view of a lid removed from a housing of the mounting device of FIG. 2*a*.

FIG. 2*b* shows a front view of a lid 7 removed from a housing 3 of the mounting device 1 of FIG. 2*a*. In this example the release mechanism 15 is arranged on the inside of the lid 7. The release mechanism 15 is in this example an angled surface 15' provided in the shape of the lid 7. When the tilted locking element 13 engages the angled surface 15' of the release mechanism 15 the sliding engagement of these surfaces results in the locking element 13 pivoting about its pivoting axis and levels out to a more horizontal positioning. A more horizontal positioning of the locking element 13 in turn means that it moves from the movement restriction state to the movement allowing state. The locking element 13 is arranged to move towards the angled surface 15' in such a way that the point of intersection of the surfaces counteracts the tilting of the locking element 13. In this case this is achieved by an angled surface 15' which is fixed within the lid 7 of the housing 3, wherein the locking element 13 is moved towards the angled surface 15'. The intersection of the two surfaces occurs on the outer longitudinal side of the locking element 13. However, the two surfaces moving towards each other may be arranged in other alternative ways, such as the angled surface 15' moving towards a bottom right surface of the locking element 13, in a direction from right to left looking at the locking element 13 as depicted in FIG. 2*a* for example. Another example is having the angled surface 15' being moved towards the locking element 13 by means of an adjustment action instead.

In the depicted example of 2*a* and 2*b* the release mechanism 15, in the form of an angled surface 15', is arranged in the lid 7 of the housing. This is however not the only possible solution to achieve the mechanics of the two interacting parts 13, 15 of the device 1. The angled surface 15' may instead be placed in the body 5 of the housing 3 and interact with the locking element 13 from the other side of the locking element 13. In this example, if the receiving element 11 positioned at the top of the adjustment element 9 is tilted outwards, in relation to the wall behind the housing 3, the locking element 13 moves to the movement allowing state. The adjustment element 9 is further supported by a section 19 of the body of the housing, which section 19 can be moved in relation to the rest of the body 5. The housing 3 is preferably, as described with reference to FIG. 1, made of a somewhat flexible metal or plastic material. This means that the section 19 of the housing 3 can be temporary flexibly displaced in relation to the rest of the body 5 and hence temporary displace the adjustment element 9 in the described tilted way. This flexibility of the material of the body 5 will then flex back when released, causing the adjustment element 9 to move back to an upright position. This creates a spring loaded-like mechanism for the adjustment element.

Figure 3A:
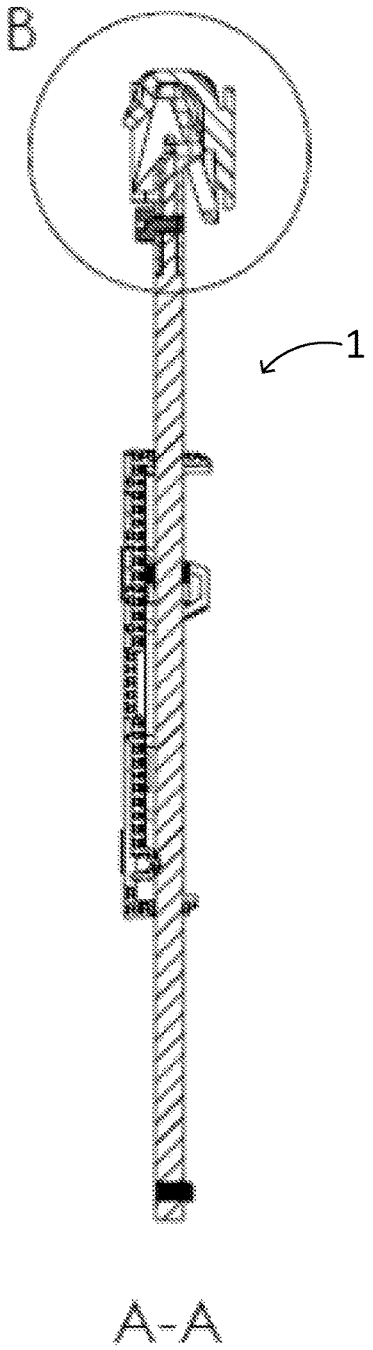
FIG. 3*a* shows a cross-sectional view of a section A-A of the mounting device of FIG. 2*a*.
Figure 3B:
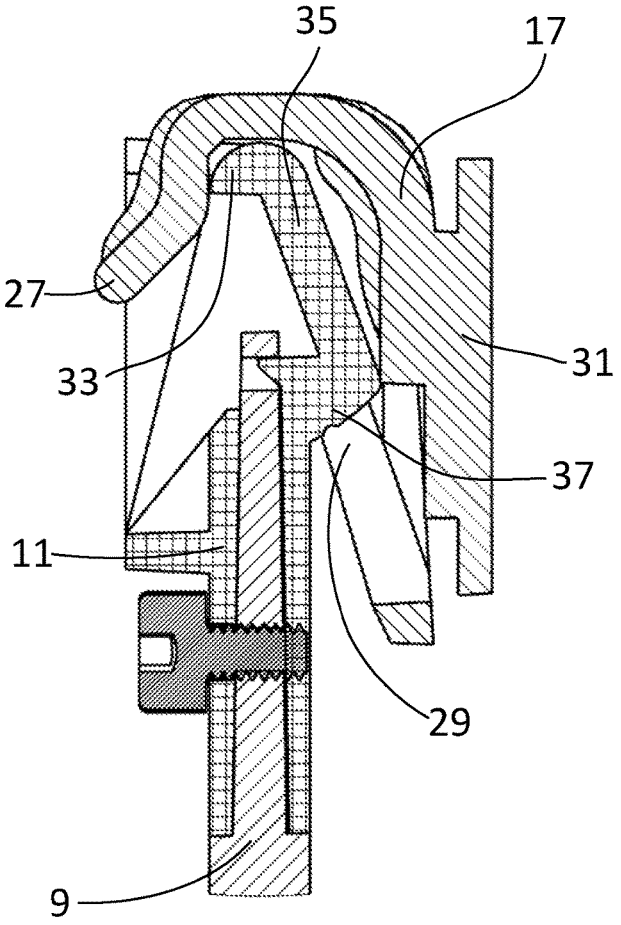
FIG. 3*b* shows an enlarged view of a receiving element and a connecting element of FIG. 3*a*.

FIG. 3*a* shows a cross-sectional view of a section A-A of the mounting device of FIG. 2*a*. FIG. 3*b* further shows an enlarged view of a receiving element 11 and a connecting element 17 of FIG. 3*a*. The connecting element 17 comprises an upper clutch 27 arranged for an upper engagement with the receiving element 11. The upper engagement with the receiving element 11 enables a firm positioning of the connecting element 17 onto the receiving element 11. The connecting element 11 further comprises a lower clutch 29, arranged for a lower engagement with the receiving element 11. This lower engagement with the receiving element 11 is designed to translate an upward movement of the connecting element 17 to a corresponding upward movement of the adjustment element 9 connected to the receiving element 11. If no lower clutch 29 was arranged on the connecting element 17, it would simply be lifted up from the receiving element 11 if moved upwards. Furthermore, the connecting element 17 comprises attachment means 31 arranged for detachable connection with an object which is to be mounted on a wall by means of the mounting device 1.

The cross sectional view of this example of the receiving element 11 comprises an upper receiving clutch 33, situated on an upper portion 35 of the receiving element 11, arranged to receive the upper clutch 27 of the connecting element 17. The receiving element 11 further comprises a lower receiving clutch 37, situated below the upper receiving clutch 35, arranged to receive the lower clutch 29 of the connecting element 11.

The above described clutches 27, 29, 35, 37 provides for detachable fixed connection of the connecting element 17 to the receiving element 11 in a way that a vertical movement of the connecting element 17 will not detach from the receiving element 11. Detachment of the connecting element 17 is however possible due to the shape and design of the two interacting elements. If the connecting element 17 depicted in FIG. 3*b* is rotated counter clockwise, which in this example would translate to the upper clutch 27 being tilted towards the wall upon which the mounting device 1 is mounted, the lower clutch 29 would disengage from the lower receiving clutch 37 of the receiving element 11. By disengaging the lower clutch 29 of the connecting element 17 from the lower receiving clutch 37 of the receiving element 11, the connecting element 17 and thereby the object can be lifted upwards to be removed from the receiving element 11 and the device 1. If this described rotating/tilting movement of the connecting element 17 is not performed, all upward and downward directed movements will translate to corresponding upward and downward movement of the adjustment element 9. Coupled with the state of the locking element 13 being selectively changed, an easy to use and precise device 1 for positioning an object on a wall is provided.

Figure 4:
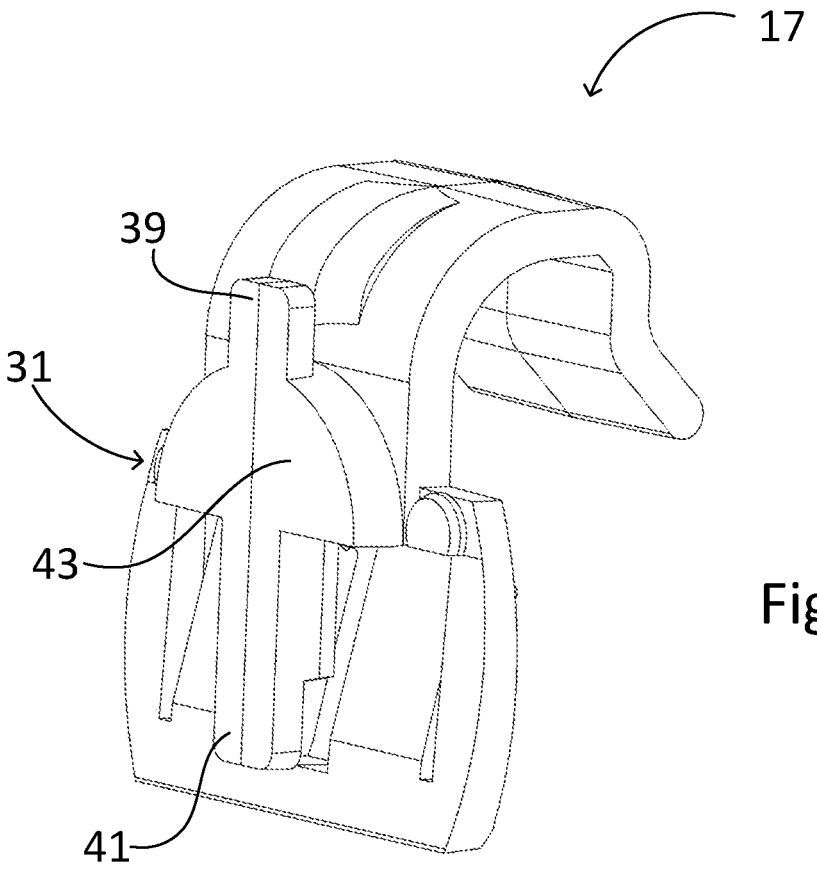
FIG. 4 shows a perspective view of an example of a connecting element.

FIG. 4 shows a perspective view of an example of a connecting element 17. This can be seen as the same type of connecting element 17 as depicted in FIG. 3*b*, only in a perspective view and de-coupled from the receiving element 11. The example of the connecting element 17 seen in FIG. 4 comprises attachment means 31 arranged for detachable connection with an object which is to be mounted on a wall by means of the mounting device 1. The attachment means 31 further comprises an upper protrusion 39 and a lower protrusion 41, both protrusions 39, 41 extending upward and downward respectively from a semi-circular disc-like profile 43 of the attachment means 31. The semi-circular disc-like profile 43 with the upper and lower protrusions 39, 41 are arranged to be fitted into a corresponding opposite hole or recess in an object, or part of an object (not shown), being mounted with the device 1. The shape and design of the attachment means 31 may of course be altered in various ways to fit with different shapes and designs of an object or part on an object being mounted with a device 1 of the present patent application. The attachment means 31 could for example instead be at least one hole arranged in the connecting element 17, which hole is adapted for attaching the connecting element 17 to an object by means of a screw or a nail for a secure fixed attachment. However, an advantage with the example depicted in FIG. 4 is a fast and easy design for inserting the connecting element 17 into a corresponding opposite shape in an object, for example a frame of a painting. If using the design and shape of the depicted example, together with a frame specifically meant for this design, a very precise and easy to use system for mounting of a painting is provided.

Figure 5:
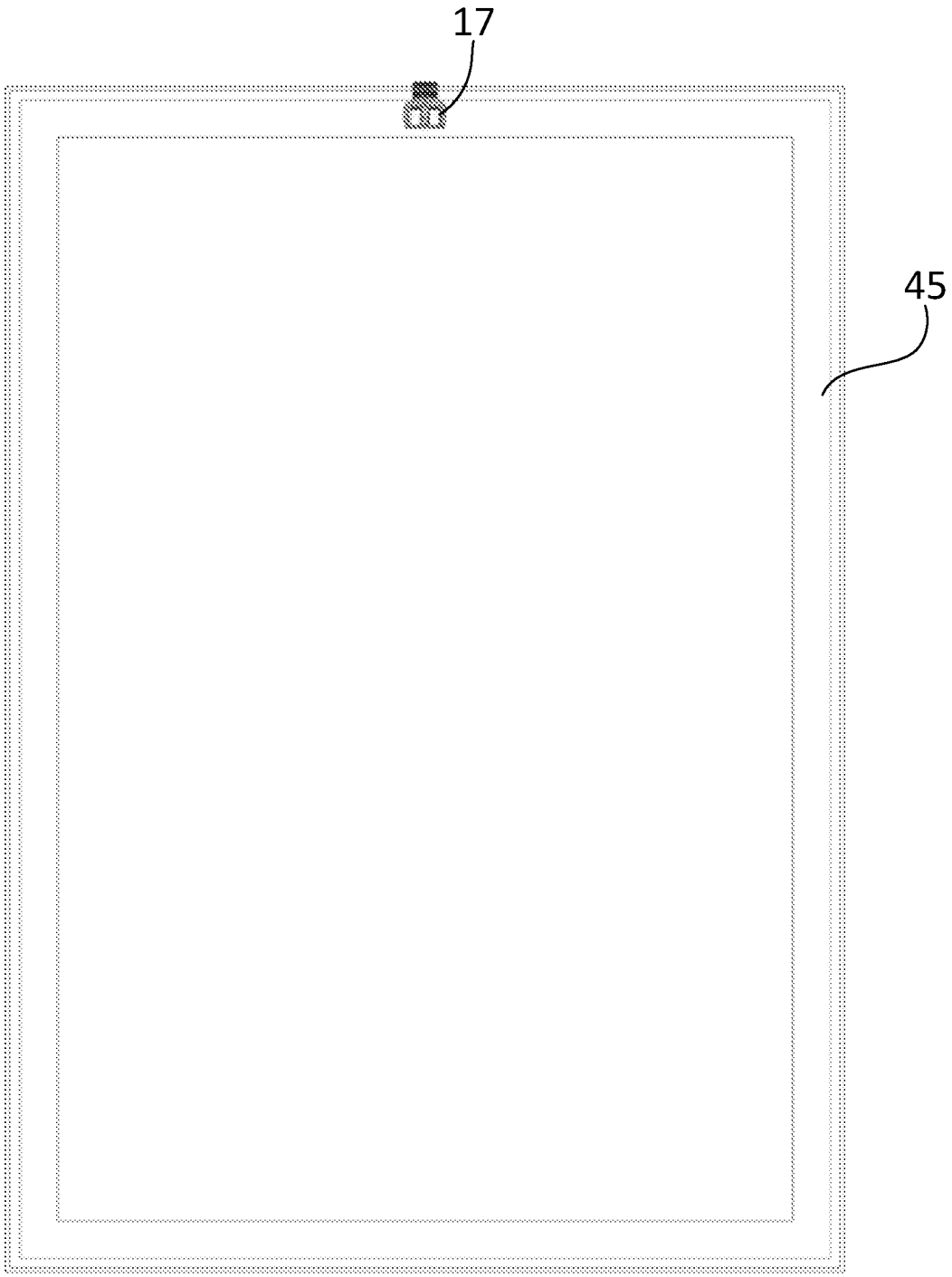
FIG. 5 shows a front view of an example of a connecting element attached to a frame for a painting.

FIG. 5 shows a front view of an example of a connecting element 17 attached to a frame 45 for a painting. This example depicts a connecting element 17 being attached to the frame 45 of a painting wherein the frame 45 is designed specifically to receive a connecting element 17 of a mounting device 1 according to an example of the invention. As the frame 45 is designed with this functionality in mind, the receiving hole or recess in the frame 45 of the painting is placed in a proper position on the frame 45 and exhibiting the correct shape for connection with the connecting element 17. This design of a frame 45 coupled with the mounting device 1 according to the invention provides a very flexible, precise and easy to use system for mounting paintings on a wall with good repeatability. This is particularly useful when mounting a plurality of paintings which are being mounted in a uniform arrangement.

FIG. 6*a*-6*d* show examples of alternative connecting elements 17. The FIGS. 6*a*-6*c* exemplifies that the connecting element 17 can be changed to be connected to several different types of objects, like frames 45, without re-designing the entire mounting device 1. The upper clutch 27 and the lower clutch 29 of the connecting elements 17 can be perceived the same as in the example depicted with reference to FIG. 4, providing the same functionality when connected to a receiving element 11 of a mounting device 1.

Figure 6A:
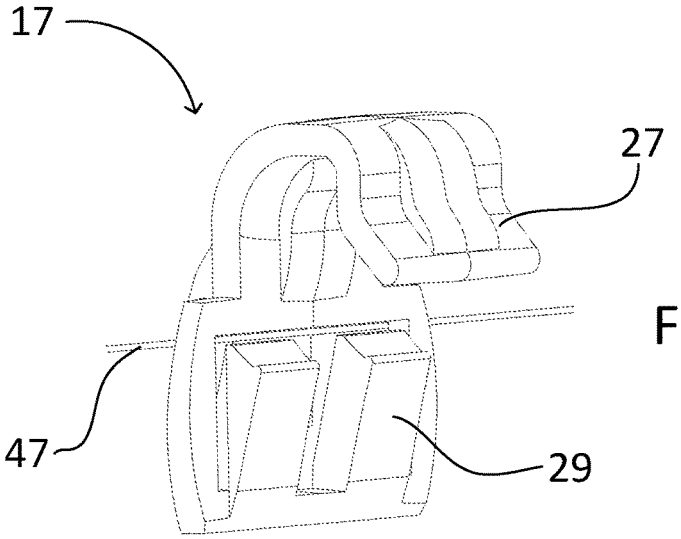
FIG. 6*a*-6*d* show examples of alternative connecting elements.

The connecting element 17 of FIG. 6*a* is designed to be connected to a wire 47. With the connecting element 17 being designed to receive a wire 47, the functionality of the mounting device 1 can be achieved without the need for a particular type of frame 45 when mounting a painting. As wires are a common way of attachment for frames 45, this variation of a connecting element 17 is very useful for a regular household usage of the device 1. The connecting element 17 can be designed to be attached to a wire 47 in various ways. For example a simple hole can be arranged in the connecting element 17, in through which hole the wire 47 is threaded. The wire 47 can then be securely attached to a frame 45 of a painting by any means of fasteners of known technology.

Figure 6B:
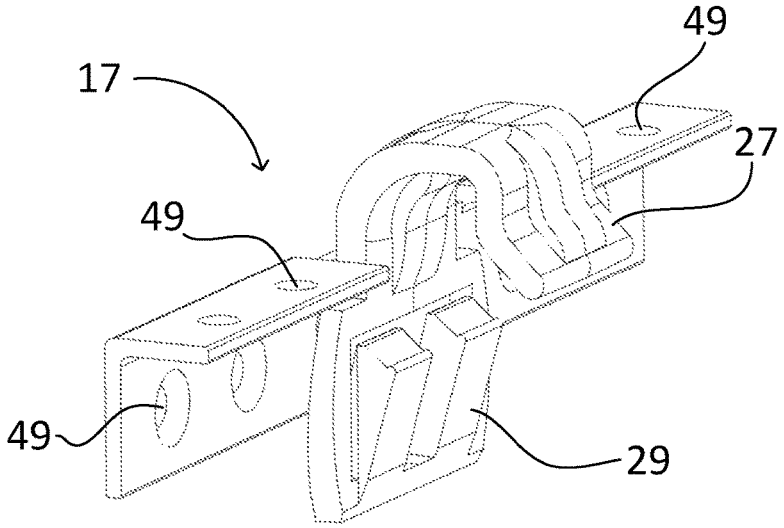

The connecting element 17 of FIG. 6*b* comprises a plurality of holes 49 arranged for attaching the connecting element 17 to a frame 45 by means of screws or nails. This is a useful variation of a connecting element 17 to use in combination with a frame 45 made of wood.

Figure 6C:
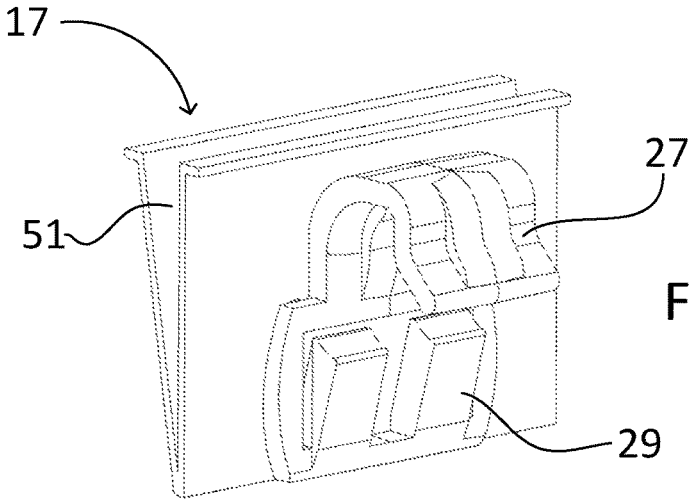

The connecting element 17 of FIG. 6*c* comprises a wedge-like recess 51, arranged in the connecting element 17 for attachment to a common type of frame 45 made of aluminium. The connecting element 17 of FIG. 6*c* is simply pushed onto an edge of said aluminium frame 45.

Figure 6D:
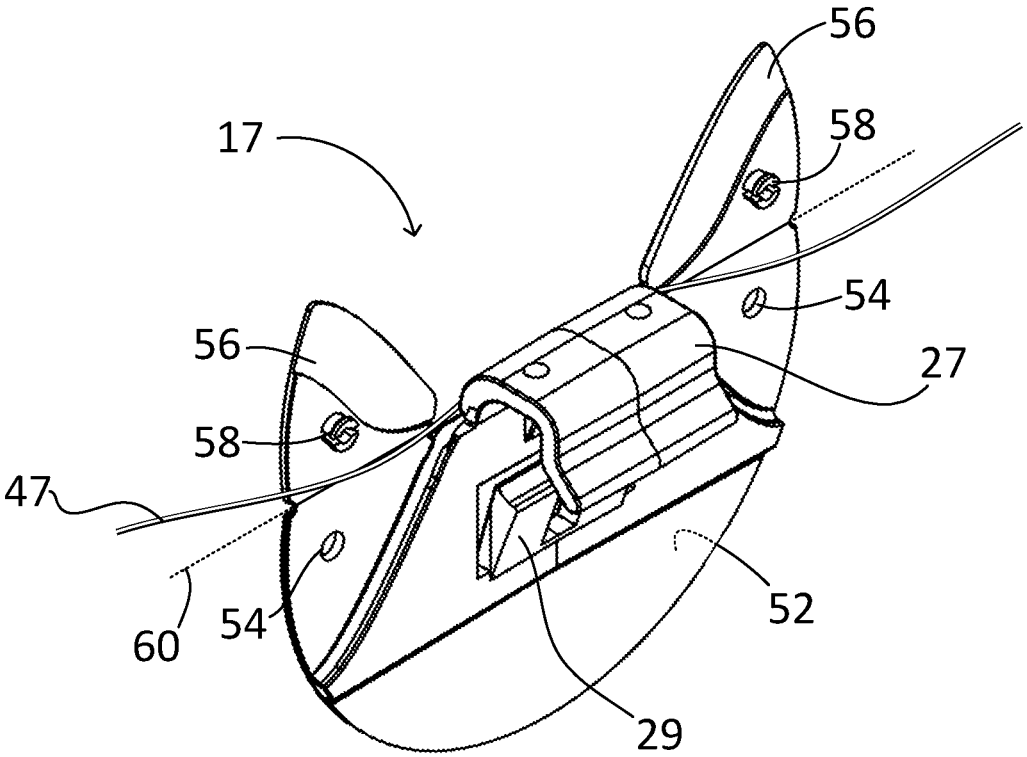

The connecting element 17 of FIG. 6*d* is a multi-purpose connecting element 17, which comprises a plurality of ways to be connected to a frame 45 or similar. The connecting element 17 of FIG. 6*d* comprises a flat back surface 52, two through holes 54, and two extending projections 56, each extending projection 56 comprising a locking element 58. The extending projections 56 are arranged to be folded about a folding line 60, wherein the two locking elements 58 engage and interlock in the two respective through holes 54. This may be used to arrange a wire 47 to the connecting element 17, extending in front of the folding line 60 and behind the upper clutch 27, wherein the extending projections 56 are folded over the wire 47 so as to hold the wire 47 in place relative the connecting element 17. The connecting element 17 may also be connected to a frame 45 by means of inserting additional fastening elements such as screw directly through the through holes 54 and into said frame 45 or similar. For such cases the two extending projections 56 may be removed from the connecting element 17 if they would risk extending up above a top edge of the frame 45 or similar. Furthermore, the flat back surface 52 of connecting element 17 may also be provided with a suitable adhesive fastener, such as a double-sided adhesive tape, a clue or other, which adhesive fastener may then be arranged on a frame 45 or similar. Thus, a versatile multi-purpose connecting element 17 is provided which may be used for a variety of types of frames 45 or similar.

As is obvious, other designs are of course also possible without deviating from the scope of the invention, and the ones described with reference to FIG. 6*a*-6*d* are merely to be seen as examples.

Figure 7A:
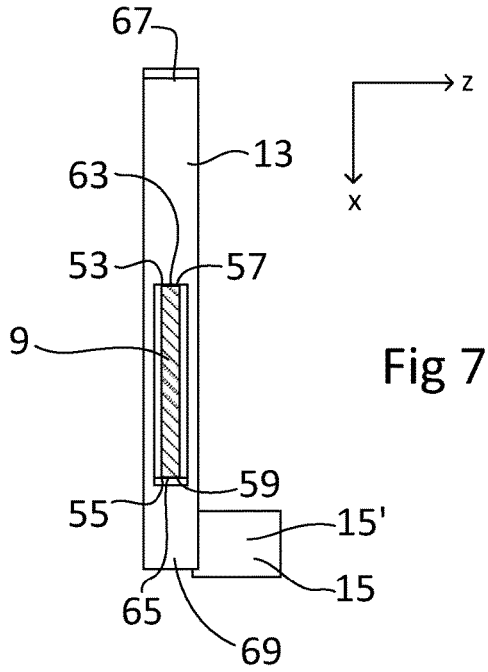
FIG. 7*a*-7*c* shows an example of an arrangement of an adjustment element, a locking element and a release mechanism, wherein the locking element is in the movement restriction state.
Figure 7B:
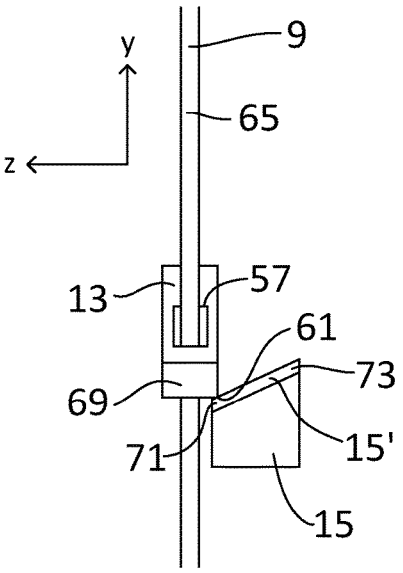
Figure 7C:
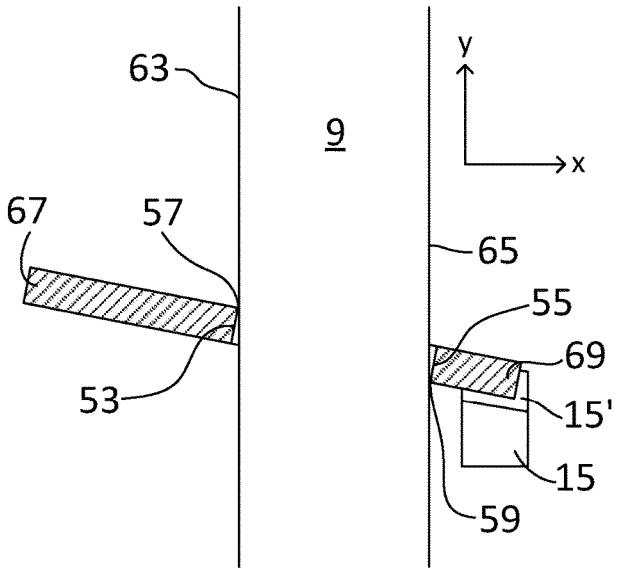
Figure 8A:
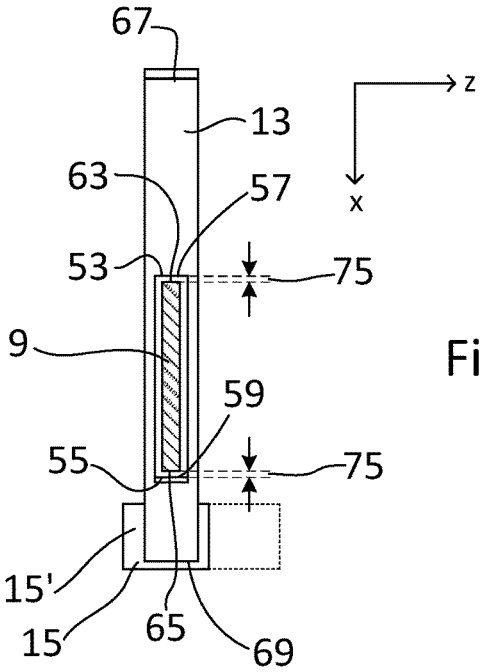
FIG. 8*a*-8*c* shows an example of an arrangement of an adjustment element, a locking element and a release mechanism, wherein the locking element is in the movement allowing state.
Figure 8B:
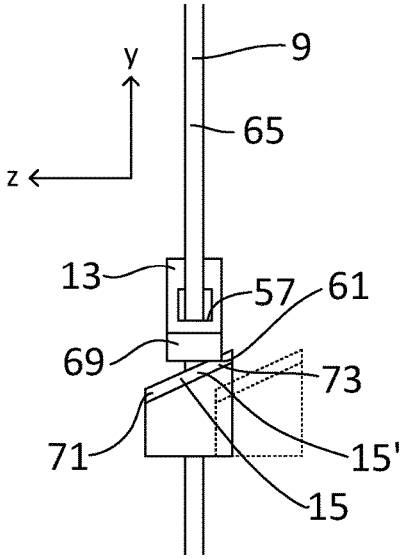
Figure 8C:
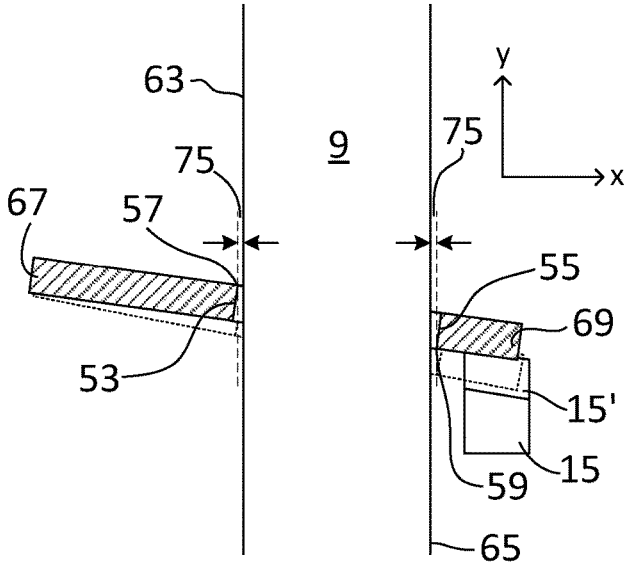

FIGS. 7*a*-7*c* and 8*a*-8*c* show different views of an example of an arrangement comprising an adjustment element 9, a locking element 13 and a release mechanism 15. The locking element 13 in FIGS. 7*a*-7*c* is in the movement restriction state and the locking element 13 in FIGS. 8*a*-8*c* is in the movement allowing state. FIGS. 7*a* and 8*a* show a top view of said arrangement. FIG. 7*b* and 8*b* show a side view of the arrangement. FIGS. 7*c* and 8*c* show a front view of the arrangement.

The hole 21 of the locking element 13 in this example comprises a first side 53 and a second side 55, wherein the first side 53 comprises an upper edge 57 and the second side 55 comprises a lower edge 59. The locking element 13 further comprises a lower outer edge 61. The adjustment element 9 comprises a first side 63 and a second side 65. Furthermore, the locking element 13 in this example is to be seen as loosely supported on a first end 67 of the locking element.

The release mechanism 15 depicted in FIGS. 7*a*-7*c* is positioned in close proximity to, but not in engagement with, the lower outer edge 61 of the locking element 13. The release mechanism 15 of this example comprises an angled surface 15'. The angled surface 15' of the release mechanism 15 is angled to substantially follow the contour of the lower outer edge 61 of the locking element 13. When no engagement of the locking element 13 and the angled surface 15' is present, gravity pulls the adjustment element 9 downwards. As the locking element 13 is loosely supported on the first end 67 only, a second end 69 of the locking element 13 is also pulled downwards by gravity. As the adjustment element 9 can only move along the y-axis depicted in the figures, the first side 53 of the adjustment element 9 will engage the upper edge 57 of the hole and the second side 55 of the adjustment element 9 will engage the lower edge 59 of the hole 21 of the locking element 13. This will prevent further downwards movement of the adjustment element 9 and further downward tilting of the locking element 13. The engagements of said first side 53 and upper edge 57, and second side 55 and lower edge 59 are seen in both FIG. 7*a* and FIG. 7*c*.

In FIGS. 8*a*-8*c* the release mechanism 15 has moved along the z-axis compared to the release mechanism 15 depicted in FIGS. 7*a*-7*c*. However, it should be noted that this movement should be seen as a relative movement between the locking element 13 and the release mechanism 15, which could be achieved by instead moving the locking element 13 towards the release mechanism 15.

When the relative movement of the release mechanism 15 and the locking element 13 is performed, the angled surface 15' of the release mechanism 15 engages the lower outer edge 61 of the locking element 13. The engagement of the lower outer edge 61 towards the angled surface 15' pushes the second end 69 of the locking element 13 upwards as the lower outer edge 61 slides from a lower side 71 of the angled surface 15' towards an upper side 73 of the angled surface 15'. This sliding displacement of the locking element 13 results in a change of the angle of the locking element 13. The change in angle of the locking element 13 further results in the alignment of the hole 21 in the locking element 13 shifting in relation to the adjustment element 9. When this alignment shift occurs, the first side 63 of the adjustment element 9 will no longer be in engagement with the upper edge 57 of the hole of the locking element 13, and the second side 65 of the adjustment element 9 will no longer be in engagement with the lower edge 59 of the hole 21 of the locking element 13. With the engagements between the locking element 13 and the adjustment element 9 alleviated, a gap 75 is provided between both elements on each side of the adjustment element 9. Hence, the locking element 13 is moved to the movement allowing state making movement of the adjustment element 9 possible in both directions along the y-axis depicted in the figures.

As should be obvious for a person skilled in the art, the different examples of the mounting device and its individual parts described herein can be combined in various ways without deviating from the inventive concept or the scope of the protection set up by the enclosed patent claims.

The invention claimed is:

1. A mounting device, for adjustable mounting of objects on a wall, the device comprising;

a housing comprising a body and a lid, wherein the body is adapted for being mounted on the wall, a substantially vertically extending adjustment element extending through the housing, a receiving element connected to a first end of the adjustment element, which receiving element is adapted for receiving the object being mounted on the wall, a locking element arranged within said housing, wherein the locking element is an extending bar in which a hole is arranged, wherein the adjustment element passes through said hole and wherein the extending bar is supported in the housing on one side of said bar, the locking element being arranged to be selectively movable between a movement restriction state restricting vertical adjustment movement of the substantially vertically extending adjustment element and a movement allowing state allowing vertical adjustment movement of the substantially vertically extending adjustment element, and a release mechanism arranged in the housing for selectively moving the locking element from the movement restriction state to the movement allowing state, wherein a relative movement of the locking element in relation to the release mechanism is controlled by moving the receiving element.

2. The mounting device according to claim 1, wherein the adjustment of the object is a stepless adjustment.

3. The mounting device according to claim 1, wherein the movement restriction state of the locking element restricts movement of the receiving element in a direction along the extension of the adjustment element, towards the housing, but allows moment of the receiving element away from the housing, and the movement allowing state of the locking element allows free movement of the receiving element both towards and away from the housing, along the extension of the adjustment element.

4. The mounting device according to claim 1, further comprising the object being mounted, and wherein moving the object being mounted, while connected to the receiving element, away from the wall, moves the locking element to the movement allowing state.

5. The mounting device according to claim 1, wherein the receiving element is a substantially horizontal extending bar, allowing connection between the receiving element and the object throughout the extension of said bar.

6. The mounting device according to claim 1, wherein the device further comprises a connecting element arranged for detachable fixed connection to the object and comprising connecting means arranged for a detachable fixed connection to the receiving element.

7. The mounting device according to claim 1, wherein the release mechanism comprises an angled surface which, when it engages the locking element, moves the locking element from the movement restriction state to the movement allowing state.

8. The mounting device according to claim 1, wherein the locking element is biased by a section of the body acting upon the substantially vertically extending adjustment element so as to not engage the release mechanism until the substantially vertically extending adjustment element is subjected to a force of a pre-determined value.

9. The mounting device according to claim 1, wherein the housing further comprises a spirit level.

* * * * *